US012663247B1

(12) United States Patent
Klein

(10) Patent No.: US 12,663,247 B1
(45) Date of Patent: Jun. 23, 2026

(54) CONNECTOR FOR USE WITH DETONATION DEVICES

(71) Applicant: Breacher's Hardware LLC, Las Vegas, NV (US)

(72) Inventor: Avner Klein, Las Vegas, NV (US)

(73) Assignee: Breacher's Hardware LLC, Las Vegas, NV (US)

( * ) Notice: Subject to any disclaimer, the term of this patent is extended or adjusted under 35 U.S.C. 154(b) by 0 days.

(21) Appl. No.: 19/193,693

(22) Filed: Apr. 29, 2025

(51) Int. Cl.
*C06C 5/06* (2006.01)
*F42D 1/04* (2006.01)
*F42D 1/06* (2006.01)

(52) U.S. Cl.
CPC ..... *F42D 1/043* (2013.01); *C06C 5/06* (2013.01); *F42D 1/06* (2013.01)

(58) Field of Classification Search
CPC ..... F42D 1/00; F42D 1/02; F42D 1/04; F42D 1/06; F42D 1/043; C06C 5/06; F42B 3/26
USPC ..... 102/275.12, 275.2, 275.4, 275.7
See application file for complete search history.

(56) References Cited

U.S. PATENT DOCUMENTS 3,987,732 A * 10/1976 Spraggs ..... C06C 5/06 102/275.7
3,987,733 A * 10/1976 Spraggs ..... F42D 1/043 102/275.3
4,187,780 A * 2/1980 Petruccelli ..... F42D 1/043 102/275.12
4,821,645 A * 4/1989 Reiss ..... F42D 1/043 102/275.12
5,012,741 A * 5/1991 Peebles ..... C06C 5/06 102/275.3
5,299,500 A * 4/1994 Lindquist ..... F42D 1/043 102/275.12
7,661,365 B2 * 2/2010 Chan ..... C06C 5/06 102/275.12
9,103,644 B2 * 8/2015 Bezuidenhout ..... C06C 5/06
9,958,246 B2 * 5/2018 Davis ..... F42D 1/043
10,066,919 B2 * 9/2018 Potter ..... F42D 1/045
11,454,482 B2 * 9/2022 Brown ..... F42D 1/04
2010/0300315 A1 * 12/2010 Davis ..... F42D 1/043 102/206
2010/0326306 A1 * 12/2010 Xiaohong ..... C06C 5/06 102/206

OTHER PUBLICATIONS

Global Assets Integrated, "Detonators/ Blasting Caps Connectors", retrieved from https://www.globalassetsintegrated.com/product-category/explosive-breaching/detonators-blasting-caps-shock-tube-related-items/detonators-blasting-caps-connectors/, 2 pages.

* cited by examiner

*Primary Examiner* — James S Bergin
(74) *Attorney, Agent, or Firm* — Endurance Law Group PLC; James R. Yee

(57) ABSTRACT

A connector for use with detonation device(s) associated with an explosive detonation system is provided. The connector includes a body, a lower channel, a first side channel, and a second side channel. The body has a first end and a second and is centered on an axis. The first end and the second end are positioned along the axis. The body defining a main channel with a first main end and a second main end. The body main, lower, first side and second side channels are configured to receive first, second, third and fourth detonation device, respectively.

11 Claims, 5 Drawing Sheets

CONNECTOR FOR USE WITH DETONATION DEVICES

TECHNICAL FIELD

The invention relates generally to explosive detonating systems, and more particularly to, a connector for use with shock tubes and/or detonation cords.

BACKGROUND OF THE INVENTION

Systems involving explosives or explosive devices have many uses, for example, military and law enforcement applications, construction, excavation and mining. Specific examples of military or law enforcement applications may include, but are not limited to breaching obstacles, such as walls, doors or the like. Generally, explosives or explosive devices are placed in a position or position(s) to meet the desired objective and detonated remotely.

For example, one or more explosive devices may be incorporated into an explosive system via which the explosive devices may be remotely and safely detonated. Such systems may generally include a firing actuator, such as a non-electric (NONEL) shock tube initiator, a NONEL shock tube, a blasting cap, and the explosive device (or main explosive).

The firing actuator is used to set-off or initiate an explosive sequence. The transmission device allows physical separation or distance between the firing actuator and the explosive device. The shock tube may have a blasting cap or detonator affixed to the end (which may be jointly referred to as a shock tube assembly) and detonation cord may be affixed together via a connector block or any suitable means. The firing actuator, when triggered, initiates the explosive sequence. The shock tube assembly delivers a signal in the form of a firing impulse to a detonation cord. A detonation cord is generally a flexible tube filled with an explosive. The blasting cap at the end to the shock tube initiates the detonation cord. The detonation cord may be taped or otherwise affixed to the shock tube.

In some systems, a connector may used to connect a shock tube to a detonation cord. Such connectors may be used to retain a shock tube, i.e., the blasting cap at the end of shock tube, in close proximity to a detonation tube. The connectors may also be used to retain a detonation cord in close proximity to another detonation cord.

Such explosive systems may be at least partially preassembled prior such that the system may be deployed rapidly. One problem presented by prior art connectors is that during rapid deployment, one end of a shock tube or detonation cord may be jostled or pulled loose from the connector. This may result in a misfire.

Additionally, prior art connectors may only be used to connect, i.e., hold in close proximity one detonation cord and one shock tube.

Other issues may arise in prior art systems, in which multiple explosive devices may be required. Often, it may be desired, or required, such the explosive devices are initiated in a specific sequence, and further, in a specific timing sequence. In prior art systems, multiple firing actuators may required. Specific timing may be achieved by using a specific length of shock tube or detonation cord. This is usually achieved by cutting the The present invention is aimed at one or more the problems identified above.

BRIEF SUMMARY OF THE INVENTION

In a first aspect of the present invention, a connector for use with detonation device(s) associated with an explosive detonation system is provided. The connector includes a body, a lower channel, and a first side channel. The body has a first end and a second and is centered on an axis. The first end and the second end are positioned along the axis. The body defining a main channel with a first main end and a second main end. The body further includes a main slot extending between the first main end and the second main end. The main channel is configured to receive a first detonation device through the main slot and to retain the first detonation device therein.

The lower channel is positioned adjacent the main channel and has a first lower end and a second lower end. The lower channel includes a lower slot extending between the first lower end and the second lower end. The lower channel is configured to receive a second detonation device through the lower slot and to retain the second detonation device therein.

The first side channel is positioned adjacent a first side of the body and has a first end of the first side channel and a second end of the first side channel. The first side channel includes a first side slot extending between the first end of the first side channel and the second end of the first side channel. The first side channel is configured to receive a third detonation device through the first side slot and to retain the third detonation device therein.

In a second aspect of the present invention, a connector for use with detonation device(s) associated with an explosive detonation system is provided. The connector includes a body, a lower channel, a first side channel, and a second side channel.

The body has a first end and a second is centered on an axis. The first end and the second end are positioned along the axis. The body defines a main channel with a first main end and a second main end and include a main slot extending between the first main end and the second main end. The main channel is configured to receive a first detonation device through the main slot and to retain the first detonation device therein. The main channel includes a flange extending outward from the first end of the main channel.

The lower channel is positioned adjacent the main channel and has a first lower end and a second lower end and includes a lower slot extending between the first lower end and the second lower end. The lower channel is configured to receive a second detonation device through the lower slot and to retain the second detonation device therein. The lower channel includes at least one extension extending from the second end of the lower channel. The main slot and the lower channel share a common wall. The common wall includes a cutout allowing an interior of the main slot to be open to an interior of the lower channel.

The first side channel is positioned adjacent a first side of the body and has a first end of the first side channel and a second end of the first side channel and includes a first side slot extending between the first end of the first side channel and the second end of the first side channel. The first side channel is configured to receive a third detonation device through the first side slot and to retain the third detonation device therein.

The second side channel is positioned adjacent a second side of the body and has a first end of the second side channel and a second end of the second side channel and includes a second side slot extending between the first end of the second side channel and the second end of the second side channel. The second side channel is configured to receive a fourth detonation device through the second side slot and to retain the fourth detonation device therein. One or more of the lower, first side, and second side channels include at least one divot located therein along the lower slot, the first side slot, and the second side slot, respectively.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1A:
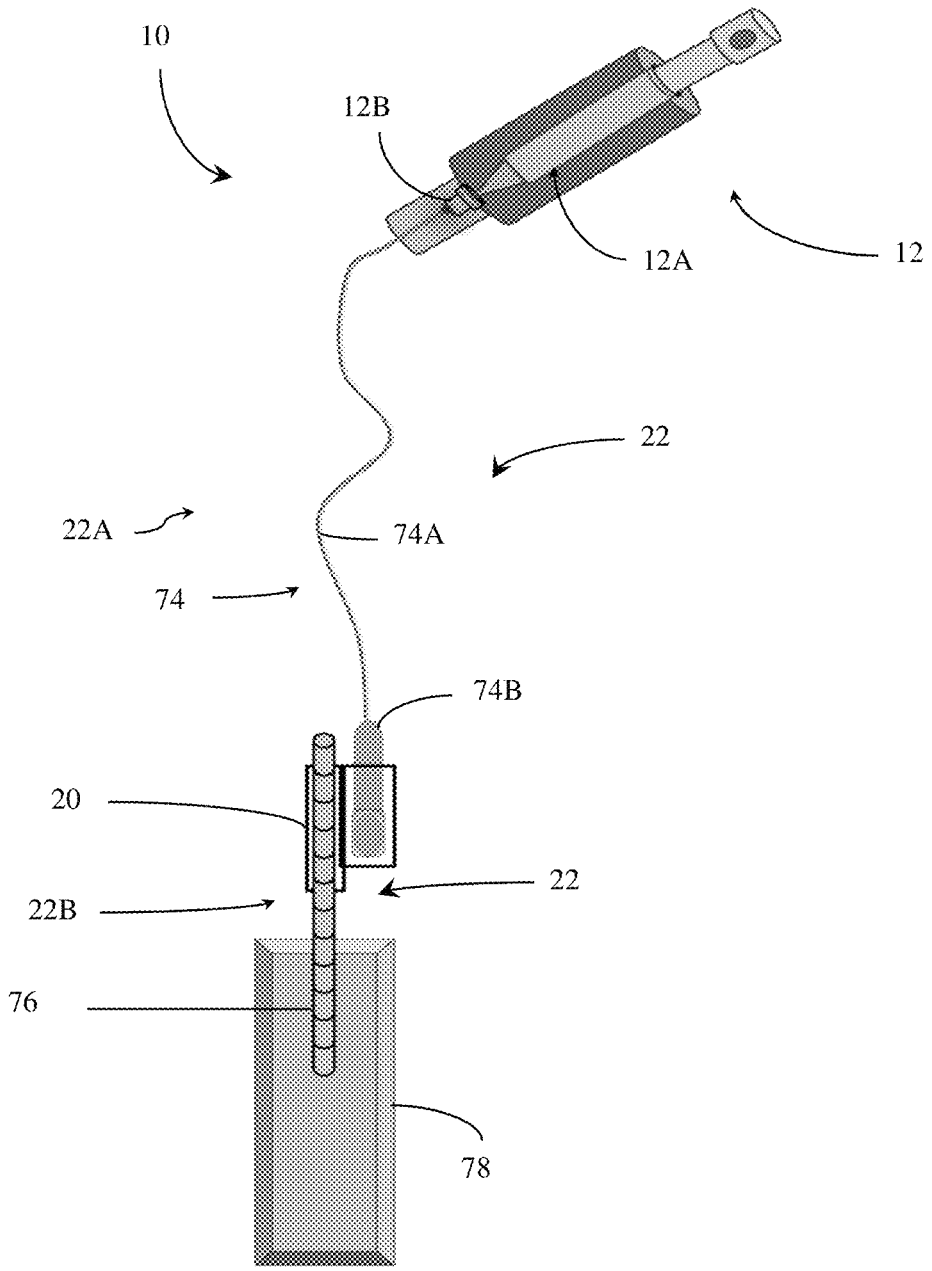
FIG. 1A is graphical representation of an explosive detonation system including a connector, according to an embodiment of the present invention.

With reference to the drawings, and in operation, the present invention provides a detonation device connector or connector 20 for use in an explosive detonation system 10. As discussed in more detail below, the connector 20 may, depending on the configuration of the explosive detonation system 10, to connect a detonation device 22 to one or more other detonation devices 22 (see below). The connector 20 may be composed from polyethene.

As will be explained in more detail below, each detonation device 22 may be a NONEL shock tube 74A, a detonation cord 76 or a blasting cap 74B or similar device. Further, a detonation device 22 with respect to the connector 20 may refer to different portions of the detonation device 22. For example, a single detonation device 22 may be looped and inserted or retained at two different portions (see below).

A shock cord 74A and a blasting cap 74B may be combined or configured into a shock tube assembly 74. In other words, a blasting cap may 74B be coupled to an end of a NONEL shock tube 74A. Thus, one end of the shock tube assembly 74 is one end of the NONEL shock tube 74A and the other end is a blasting cap 74B.

In the illustrated embodiments, the connector 20 is configured to connect or retain four detonation devices 22. Each detonation device 22 may be position or located within a channel (see below) of the connector 20. Thus, in the illustrated embodiments, each connector 20 includes four channels.

However, in other embodiments, the connector 20 may be configured with three channels or with five or more channels.

Further, the channels may be specifically sized to receive a specific type of detonation device. For example, in the illustrated embodiment, the connector 20 is configured to receive a detonation cord 76 and three shock tube assemblies 74 (either the shock tube end or the blasting cap end). Thus, one of the channels of the connector 20 may be sized to receive and retain a detonation cord 76, via, for example, a friction fit. Generally, the diameter of a NONEL shock tube and a blasting cap are similar. Thus, the other channels of the connector 20 may be sized to receive either end of a shock tube assembly. It should be noted that the connector 20 may be configured differently, i.e., the connector 20 may be configured with a different number of channels and/or the individual channels may be configured or sized to receive different types of detonation devices 22.

Figure 1B:
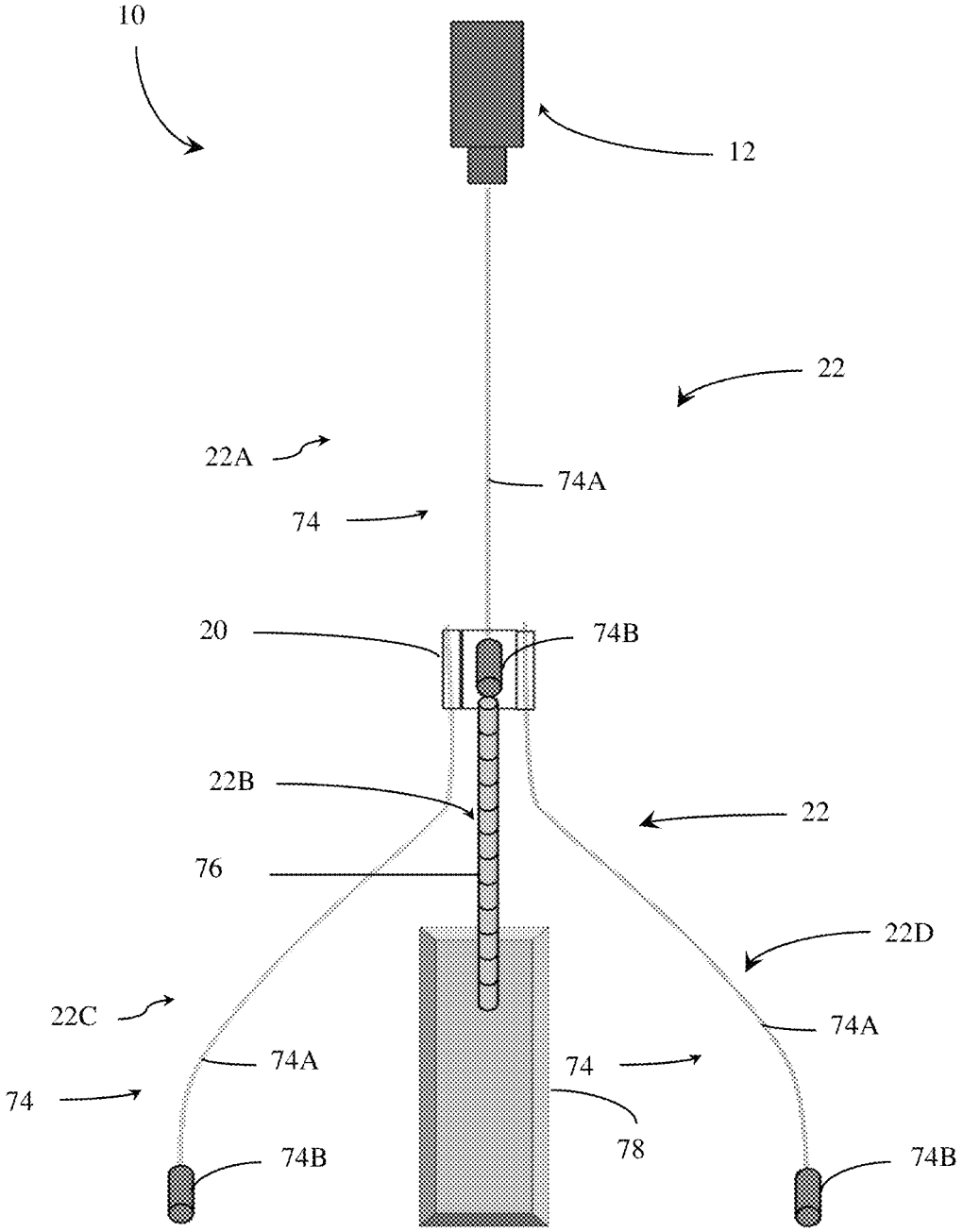
FIG. 1B is a second graphical representation of the explosive detonation system of FIG. 1A, according to an embodiment of the present invention.

With specific reference to FIGS. 1A and 1B, an exemplary explosive detonation system 10 including a connector 20 according to an embodiment of the present invention is shown. It should be noted that the explosive detonation system 10 is exemplary only and includes a single connector 20. However, the connector 20 may be used in more complex detonation systems 10 which may include multiple connectors 20.

The exemplary explosive detonation system 10 includes a firing actuator, i.e., a non-electrical (NONEL) shock tube initiator 12 and a connector 20. A first detonation device 22A is connected between the NONEL shock tube initiator 12 and the connector 20.

In the illustrated example, the first detonation device 22A is a shock tube assembly 74 including a NONEL shock tube 74A and a blasting cap 74B. As shown, the NONEL shock tube 74A forms one end of the shock tube assembly 74 which is connected to the shock tube initiator 12. The blasting cap 74 forms the other end of the shock tube assembly 74 which is connected to, i.e., received in a channel (see below) of the connector 20. As shown, the shock tube initiator 12 may include a NONEL shock tube initiator 12A and the shotgun primer 12B. In response to the triggering of the NONEL shock tube initiator 12A, the shotgun primer 12B detonates resulting in a shock wave traveling down the NONEL shock tube 74A. When the shock wave reaches the opposite end of the NONEL shock tube 74A, the shock wave detonates the blasting cap 74B. As shown in FIG. 1A, the connector 20 receives and retains the shock tube assembly 74 and the second detonation device 22B. In the illustrated embodiment, the second detonation device 22B is a detonation cord 76. One end of the detonation cord 76 is received and retained within the connector 20. The other end of the detonation cord 76 is connected or coupled to an explosive such as an explosive or high explosive 78. The high explosive 78 could be made from a detonation cord, a heat explosive M112 C4, or other explosive.

For simplicity purposes, although the connector 20 of FIG. 1A is capable of receiving and retaining additional detonation devices, the system 10 as shown in FIG. 1A only includes the first and second detonation devices 22A, 22B. Third and fourth detonation devices 22C, 22D have been added to the system 10 in FIG. 1B. In the illustrated embodiment, each of the third and fourth detonation devices 22C, 22D are shock cords assemblies 74, including a a shock cord 74A and a blasting cap 74B. One end of each shock cord 74A may be received and retained in a respective channel (see below) of the connecter 20. The blasting cap 74 of each shock cord assembly 74 may be connected or coupled to another explosive (not shown) either directly, for example, using tape, or another connector (not shown). In this manner, complex systems 10 may be designed using one or multiple connectors 20 connected together by a combination of detonation devices 22, for example, shock cord assembly 74. Complex sequence or timing of explosions or detonations may be configured by varying the length of the shock cords 74 between the firing actuation 12 and the connector(s) 20 and/or between connectors 20. In a particular system 10, connectors and/or explosives may connected in parallel and/or in series to achieve the desired results.

The connector 20 allows the first detonation device 22A to be connected, i.e., retained in close proximity to, one or more other detonation devices 22. In the illustrated example, the connector 20 allows second, third and fourth detonation devices 22B, 22C, 22D to be held or retained in contact or close proximity to the first detonation device 22A and to each of the other detonation devices 22B, 22C, 22D. Since each of the detonation devices 22A, 22B, 22C, 22D may be a NONEL shock tube, detonation cord, or the like, the connector 20 of the present invention allows for different configurations within the explosive detonation system 10. For example, the second, third and fourth detonation devices 22B, 22C, 22D may be detonation cords (connected to a main explosive 14) which are triggered by the first detonation device 22A. Alternatively, one or more of the second, third and fourth detonation devices 22B, 22C, 22D may be connected (at an opposite end) to a connector 20 (and thereby to additional detonation devices 22). Thus, allows multiple connectors 20 to be daisy-chained via different combinations detonation devices 22, e.g., NONEL shock tubes and/or detonation cords, to provide numerous configurations.

As discussed in more detail below, the detonation devices 22 may be retained in different channels (see below) within the connector 20. In practice, a single detonation device 22 may be inserted or retained within two of the channels. This allows the detonation device 22 to be more securely retained.

With specific reference to FIGS. 2-8, an exemplary connector 20 according to an embodiment of the present invention is shown.

In the illustrated embodiment, the connector 20 includes a body 24 with a main channel 36, a lower channel 44, a first side channel 52, and a second side channel 60. As discuss in more detail below, each channel 36, 44, 52, 60 is configured to receive and retain a detonation device 22 such as a NONEL shock tube or detonation cord.

Figure 2:
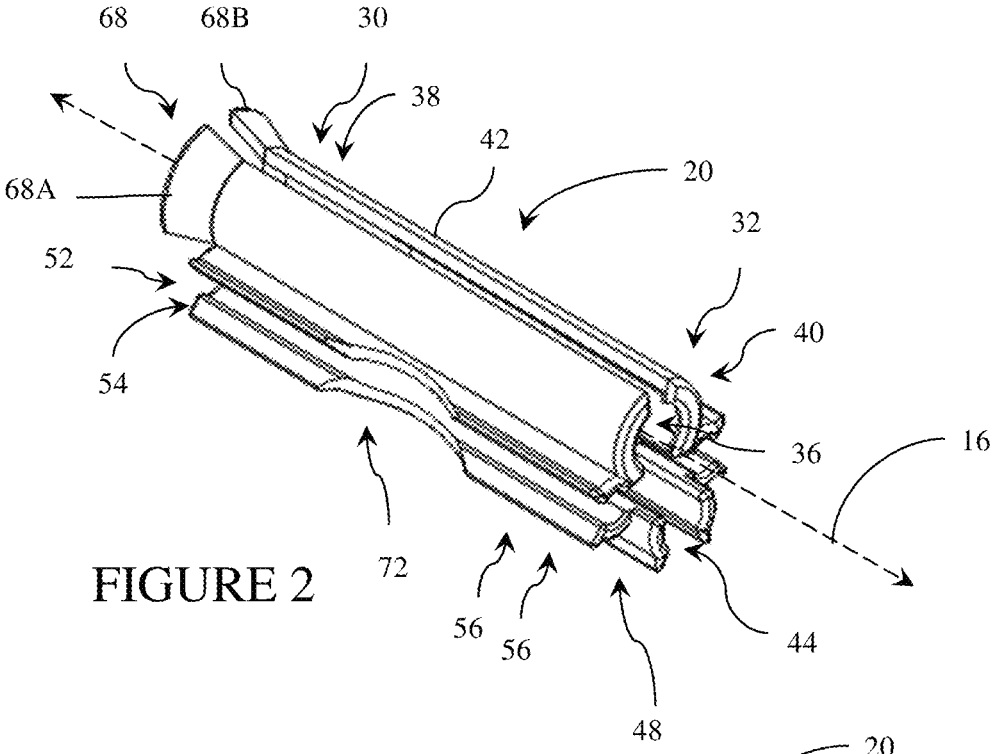
FIG. 2 is a first perspective view of the connector of FIGS. 1A and 1B, according to an embodiment of the present invention.
Figure 3:
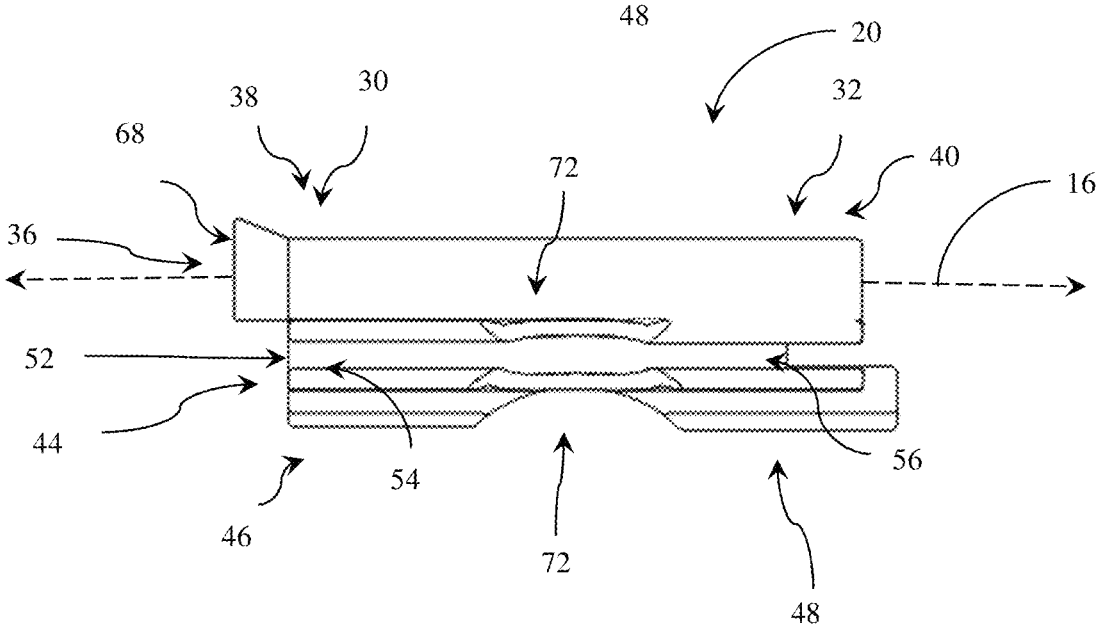
FIG. 3 is a side view of the connector of FIGS. 1A and 1B
Figure 4:
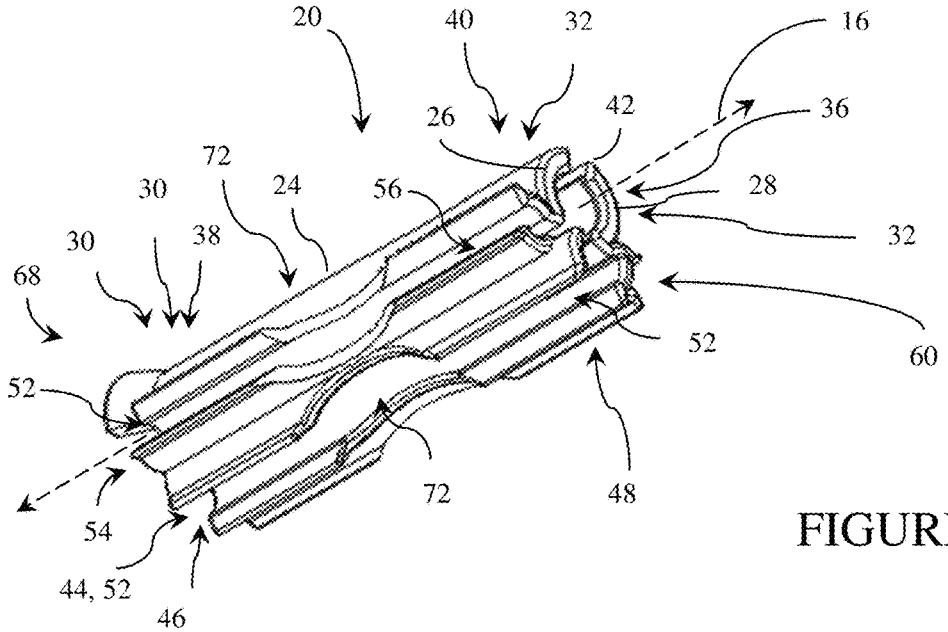
FIG. 4 is a second perspective view of the connector of FIGS. 1A and 1B.
Figure 5:
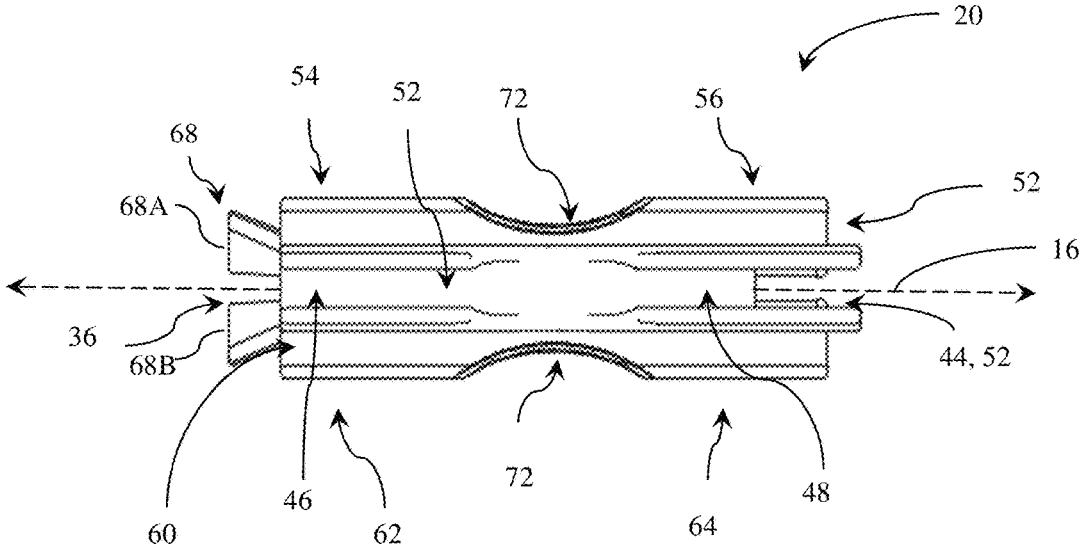
FIG. 5 is a top view of the connector of FIGS. 1A and 1B.
Figure 6:
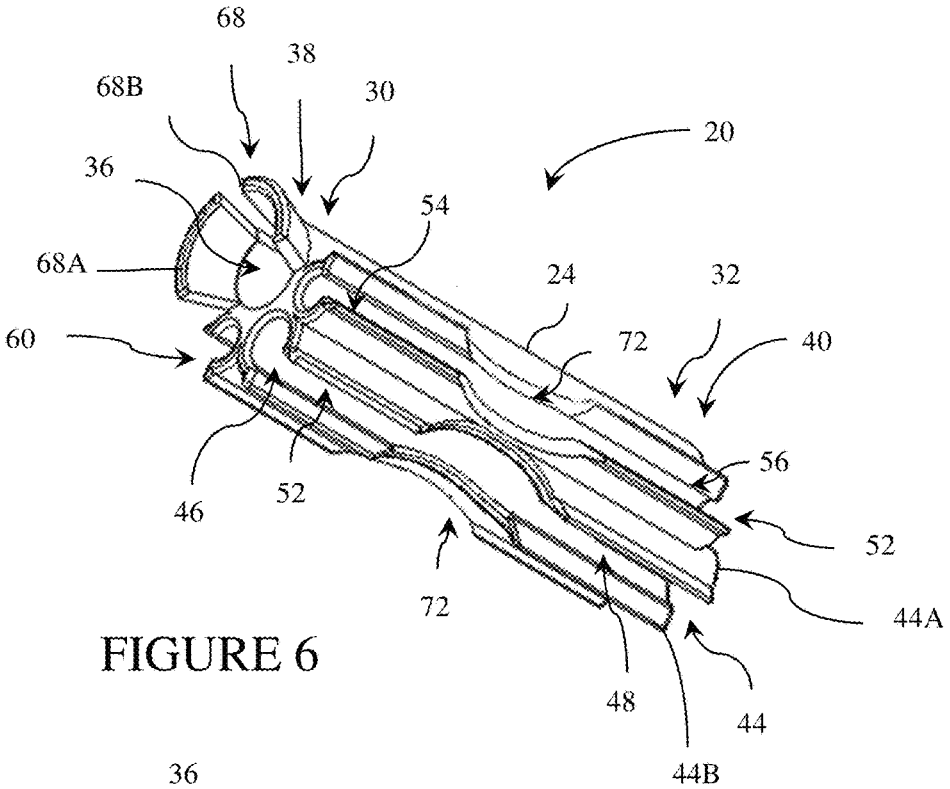
FIG. 6 is a third perspective view of the connector of FIGS. 1A and 1B.

With specific referent to FIGS. 2-3, the body 24 has a first end 30 and a second 32 and is centered on an axis 16. The first end 30 and the second end 32 are positioned along the axis 16.

The lower channel 44 is positioned adjacent the main channel 36 and has a first lower end 44A and a second lower end 44B. The lower channel 44 includes a lower slot 50 extending between the first lower end 44A and the second lower end 44B. The lower channel 44 is configured to receive the first detonation device 22A through the lower slot 50 and to retain the first detonation device 22A therein.

The body 24 defines the main channel 36. The main channel 36 has a first main end 36A and a second main end 36. The body 24 further includes a main slot 42 extending between the first main end 36A and the second main end 36B. The main channel 36 is configured to receive the second detonation device 22B through the main slot 42 and to retain the second detonation device 22B therein. In the illustrated embodiment, the main channel 36 may be configured or sized to receive and retain a detonation cord 76 (as the first detonation device The first side channel 52 is positioned adjacent a first side of the body 24 and has a first end 52A of the first side channel 52 and a second end 52B of the first side channel 52. The first side channel 52 includes a first side slot 58 extending between the first end 52A of the first side channel 52 and the second end 52B of the first side channel 52. The first side channel 52 is configured to receive the third detonation device 22C through the first side slot 58 and to retain the third detonation device 22C therein.

The second side channel 60 is positioned adjacent a second side of the body 24 (opposite the first side of the body 24) and has a first end 60A of the second side channel 60 and a second end 60B of the second side channel 60 and includes a second side slot 66 extending between the first end 60A of the second side channel 60 and the second end 60B of the second side channel 60. The second side channel 60 is configured to receive the fourth detonation device 22D through the second side slot 66 and to retain the fourth detonation device 22D therein.

In one of the embodiment of the present invention, the main channel 36 includes a flange 68 extending outward from the first end 38 of the main channel 36 (which may be referred to as the first main end). The flange 68 is configured to assist with maintaining a detonation device 22 seated within the main channel 36 if/when force is applied to the detonation device 22. In the illustrated embodiment, the flange 68 may include a pair of side flanges 68A, 68B connected to the first end 38 of the main channel 36 adjacent opposite sides of the main slot 42.

Further, the lower channel 44 may include at least one extension 44A, 44B extending from the second end 46 of the lower channel 44 (which may be referred to as the second lower end). In the illustrated embodiment, the lower channel 44 includes a pair of extensions 44A, 44B. The pair of extensions 44A, 44B are configured to keep the detonation device 22 in the lower channel 44 (or the second detonation device 44B) in line or adjacent to a detonation device 22 in the main channel 36 (see FIG. 7).

Figure 7:
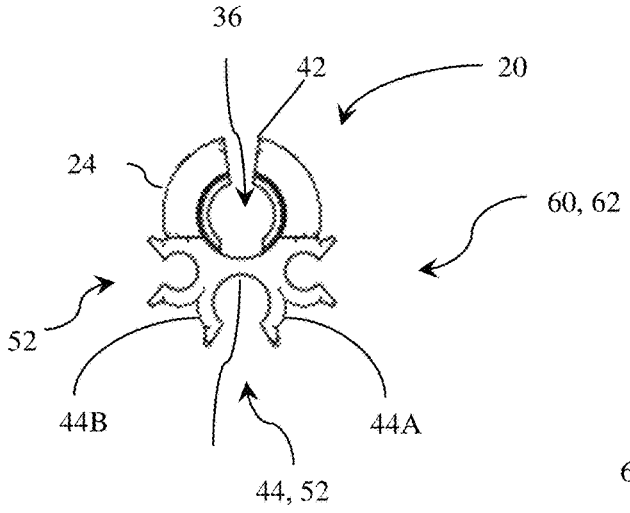
FIG. 7 is a front view of the connector of FIGS. 1A and 1B.
Figure 8:
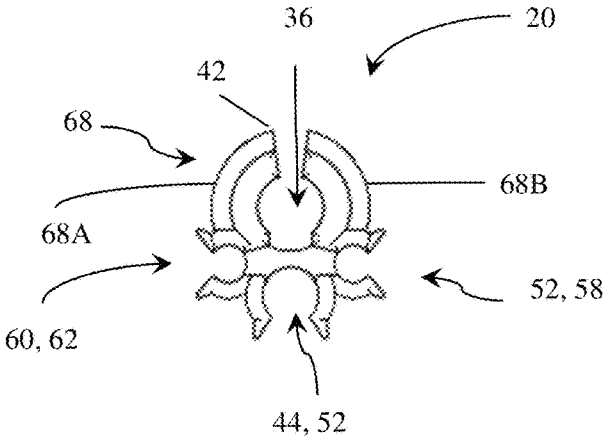
FIG. 8 is a rear view of the connector of FIGS. 1A and 1B.

As shown in FIG. 7, the main channel 36 and the lower channel 44 share a common wall 70. The common wall 70 may include a cutout 72 (see FIG. 5) configured to allow an interior of the main channel 36 to be open to an interior of the lower channel 44.

With reference to FIGS. 2-6, one or more of the lower, first side, and second side channels 44, 52, 60 may include at least one divot 72 located therein along the lower slot 50, the first side slot 58, and the second side slot 66, respectively. In some applications, it may be desirable to wrap the assembly (the connector 20 and insert detonation devices 22) in tape to minimize the risk of one or more of the detonation devices 22 from being dislodged). The divot 72 is configured to assist in allowing the tape to be contact with the detonation devices 22 and maintain the integrity of the entire assembly.

INDUSTRIAL APPLICABILITY

With reference to the drawings, and in operation, a connector 20 for connecting or coupling multiple detonation devices 22 together in an explosive detonation system 10 is provided. In some embodiments, the connector 20 allows three more or detonation devices 22 to be coupled together. In the illustrated embodiment, the connector 20 includes four channels 36, 44, 52, 60 configured to receive a respective detonation device.

Detonation devices may includes NONEL shock tubes, blasting caps, detonation cords and the like. Each channel may be sized to receive a specific type of detonation device 22. In the illustrated embodiment, the connector 20 includes a main channel 36, a lower channel 44, and first and second side channels 52, 60. Further, in the illustrated embodiment, the main channel is configured to receive and retain a detonation cord 76 and the lower, first side, and second side channels are configured to receive and retain a shock tube assembly 74.

It should be noted that in some applications, each channel 36, 44, 52, 60 may receive a separate detonation device 22. However, in some applications a single detonation device 22 may be looped and inserted into two different channels, for example the first and second side channels 52, 60. This may assist in minimizing the risk of the detonation device 22 from being dislodged from the connector 20, and potentially resulting in a mis-fire.

As mentioned above, an explosive detonation system 10 may including multiple connectors 20 connected by different lengths of shock tube assemblies 74 to achieve a specific sequence and/or timing of explosions. The length of NONEL shock tubes 74A between explosives or connectors may be used to achieve the desired timing. Shock tubes assemblies 74 may be cut to achieve the desired length or timing between explosions. Alternatively, the channels 44, 52, 60 of the connector 20 of the present invention, allows the detonation devices 22 to be received and slid or moved within a respective channel 44, 52, 60 to meet or provide the desired timing.

In order to ensure that a detonation device 22 triggers another one (or all) of the detonation devices 22 within the same connector 20, the connector 20 is configured to designed to connect or couple the detonation devices 22. This may mean that the detonation devices 22 are held in contact with each other and/or held within a specified minimum distance, for example, _1.5 mm of each other (which may be defined by distance in the body 24 between the main channel 36 and the lower channel 44).

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A connector for use with detonation device(s) associated with an explosive detonation system, comprising:

a body with a first end and a second end is centered on an axis, the first end and the second end being positioned along the axis, the body defining a main channel having a first main end and a second main end and including a main slot extending between the first main end and the second main end, the main channel configured to receive a first detonation device through the main slot and to retain the first detonation device therein;

a lower channel positioned adjacent the main channel and having a first lower end and a second lower end and including a lower slot extending between the first lower end and the second lower end, the lower channel configured to receive a second detonation device through the lower slot and to retain the second detonation device therein; and, a first side channel positioned adjacent a first side of the body and having a first end of the first side channel and a second end of the first side channel and including a first side slot extending between the first end of the first side channel and the second end of the first side channel, the first side channel configured to receive a third detonation device through the first side slot and to retain the third detonation device therein.

2. The connector, as set forth in claim 1, further including a second side channel positioned adjacent a second side of the body and having a first end of the second side channel and a second end of the second side channel and including a second side slot extending between the first end of the second side channel and the second end of the second side channel, the second side channel configured to receive a fourth detonation device through the second side slot and to retain the detonation device therein.

3. The connector, as set forth in claim 2, wherein one or more of the lower, first side, and second side channels include at least one divot located therein along the lower slot, the first side slot, and the second side slot, respectively.

4. The connector, as set forth in claim 2, wherein each first, second, third and fourth detonation devices are one of a non-electrical (NONEL) shock tube, a detonation cord, or a blasting cap.

5. The connector, as set forth in claim 4, wherein the flange includes a pair of side flanges connected to the first end of the main channel adjacent sides of the main slot.

6. The connector, as set forth in claim 4, wherein each first, second, third and fourth detonation devices are one of a non-electrical (NONEL) shock tube, a detonation cord, or a blasting cap.

7. The connector, as set forth in claim 1, wherein the main channel includes a flange extending outward from the first end of the main channel.

8. The connector, as set forth in claim 3, wherein the flange includes a pair of side flanges connected to the first end of the main channel adjacent sides of the main slot.

9. The connector, as set forth in claim 1, wherein the lower channel includes at least one extension extending from the second end of the lower channel.

10. The connector, as set forth in claim 1, wherein the main channel and the lower channel share a common wall, the common wall including a cutout allowing an interior of the main channel to be open to an interior of the lower channel.

11. A connector for use with detonation devices associated with explosives, comprising:

a body with a first end and a second end is centered on an axis, the first end and the second end being positioned along the axis, the body defining a main channel having a first main end and a second main end and including a main slot extending between the first main end and the second main end, the main channel configured to receive a first detonation device through the main slot and to retain the first detonation device therein, the main channel includes a flange extending outward from the first end of the main channel;

a lower channel positioned adjacent the main channel and having a first lower end and a second lower end and including a lower slot extending between the first lower end and the second lower end, the lower channel configured to receive a second detonation device through the lower slot and to retain the second detonation device therein, wherein the lower channel includes at least one extension extending from the second end of the lower channel, wherein the main channel and the lower channel share a common wall, the common wall including a cutout allowing an interior of the main channel to be open to an interior of the lower channel;

a first side channel positioned adjacent a first side of the body and having a first end of the first side channel and a second end of the first side channel and including a first side slot extending between the first end of the first side channel and the second end of the first side channel, the first side channel configured to receive a third detonation device through the first side slot and to retain the third detonation device therein; and, a second side channel positioned adjacent a second side of the body and having a first end of the second side channel and a second end of the second side channel and including a second side slot extending between the first end of the second side channel and the second end of the second side channel, the second side channel configured to receive a fourth detonation device through the second side slot and to retain the fourth detonation device therein, wherein one or more of the lower, first side, and second side channels include at least one divot located therein along the lower slot, the first side slot, and the second side slot, respectively.

* * * * *